US011162299B2

(12) United States Patent
Napier et al.

(10) Patent No.: US 11,162,299 B2
(45) **Date of Patent: *Nov. 2, 2021**

(54) MAGNETIC WINDOW ATTACHMENTS

(71) Applicant: Cortex, LLC, Knoxville, TN (US)

(72) Inventors: Rodney Napier, Knoxville, TN (US); Zachary P. Beard, Jefferson City, TN (US)

(73) Assignee: Cortex, LLC, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/908,809

(22) Filed: Jun. 23, 2020

(65) Prior Publication Data

US 2020/0318423 A1 Oct. 8, 2020

Related U.S. Application Data

(63) Continuation-in-part of application No. 16/380,141, filed on Apr. 10, 2019, now Pat. No. 10,724,290.

(60) Provisional application No. 62/656,606, filed on Apr. 12, 2018.

(51) Int. Cl.

| | |
|---|---|
| ***E06B 3/66*** | (2006.01) |
| ***E06B 3/667*** | (2006.01) |
| ***E06B 3/28*** | (2006.01) |

(52) U.S. Cl.

CPC ..... *E06B 3/6675* (2013.01); *E06B 3/28* (2013.01); *E06B 3/6604* (2013.01)

(58) Field of Classification Search

CPC ..... E06B 3/6604; E06B 3/6675; E06B 3/99

See application file for complete search history.

(56) References Cited

U.S. PATENT DOCUMENTS

| | | | | | |
|---|---|---|---|---|---|
| 3,099,865 | A * | 8/1963 | Burnett | E06B 3/685 | 52/204.61 |
| 3,293,817 | A * | 12/1966 | Macgregor | E06B 3/685 | 52/456 |
| 8,225,562 | B2 * | 7/2012 | Parker | E06B 3/6604 | 52/204.61 |
| 2002/0162288 | A1 * | 11/2002 | Kane | B44C 5/0407 | 52/204.59 |
| 2005/0284062 | A1 * | 12/2005 | Hsieh | E04F 21/0092 | 52/384 |
| 2008/0155913 | A1 * | 7/2008 | Magill | E06B 3/667 | 52/204.61 |
| 2008/0163572 | A1 * | 7/2008 | Lee | E06B 3/667 | 52/204.61 |
| 2016/0130864 | A1 * | 5/2016 | Gaines | A47H 23/02 | 52/204.59 |
| 2018/0055267 | A1 * | 3/2018 | Gaines | A47H 23/02 | |

FOREIGN PATENT DOCUMENTS

| | | | | |
|---|---|---|---|---|
| GB | 2465982 | A * | 6/2010 | B43M 15/00 |
| JP | 10052997 | A * | 2/1998 | |

* cited by examiner

*Primary Examiner* — Babajide A Demuren

(74) *Attorney, Agent, or Firm* — Luedeka Neely Group, P.C.

(57) ABSTRACT

A retrofit window kit includes a plurality of magnetic sash elements configured to be positioned at one or more locations on an interior perimeter of the sash and a corresponding plurality of magnetic window grid elements each configured to magnetically couple to one of the magnetic sash elements and constructed as a clip or a cap that fits over and frictionally attaches to an exterior end of a window grid muntin.

16 Claims, 17 Drawing Sheets

MAGNETIC WINDOW ATTACHMENTS

CROSS-REFERENCE TO RELATED APPLICATION

This application claims priority to nonprovisional patent application Ser. No. 16/380,141 filed Apr. 10, 2019, entitled MAGNETIC WINDOW GRIDS, which claims priority to provisional application Ser. No. 62/656,606 filed Apr. 12, 2018, entitled MAGNETIC WINDOW GRIDS, incorporated herein by reference in its entirety.

FIELD

The present disclosure relates to magnetic attachment structures. More particularly, the disclosure relates to structures, including retrofit structures, for application to windows and window grids to enable window grids to be secured to windows or window frames using magnetic materials.

BACKGROUND

Removable window grids are among structures desiring improvement. These grids are typically configured to include mechanical fasteners such as pins embedded in plastic clips to engage the grids to a window frame. The installation and removal of such grids from windows is fraught with frustration. Often, the grids are set crooked and the grids often detach and fall. This most commonly occurs when raising a blind or when opening a window.

The present disclosure advantageously provides window grid structures incorporating magnetic materials configured to enable simple installation and removal of window grids, and yielding aesthetically pleasing window grids which avoid many of the shortcomings associated with conventional window grids.

The disclosure provides structures for retrofitting existing window grids and windows, as well as structures that may be provided with windows and grids when manufactured. The structures are also applicable for use with window screens, additional glazing, and like structures.

SUMMARY

The above and other needs are met by retrofit window kits and window systems having magnetically positioned removable members, such as a window grid and screens.

In one aspect, a retrofit window kit according to the disclosure includes a plurality of magnetic sash elements configured to be positioned at one or more locations on an interior perimeter of the sash. The kit also includes a corresponding plurality of magnetic window grid elements each configured to magnetically couple to one of the magnetic sash elements and constructed as a clip or a cap sized to fit over and frictionally attach to an exterior end of a window grid muntin. The window grid muntin may also be configured to hold signage that include text or graphics.

In another aspect, a window system according to the disclosure includes a window having a sash with a pane, magnetic sash elements located proximate the sash, a grid that is removably positionable on the sash so as to overlie the pane, and magnetic grid elements located on the grid and configured to magnetically couple to the magnetic sash elements when the grid is positioned on the sash. The magnetic sash elements or the magnetic grid elements may comprise a magnetic coating.

In a further aspect, a window system according to the disclosure includes a window having a sash with a pane surrounded by an interior perimeter of the sash, magnetic sash elements located on the interior perimeter of the sash, a continuous frame having an exterior perimeter that is removably positionable on the sash so as to overlie the pane with the exterior perimeter of the frame adjacent the interior perimeter of the sash, and magnetic frame elements located on the exterior perimeter the frame and configured to magnetically couple to the magnetic sash elements when the frame is positioned on the sash.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
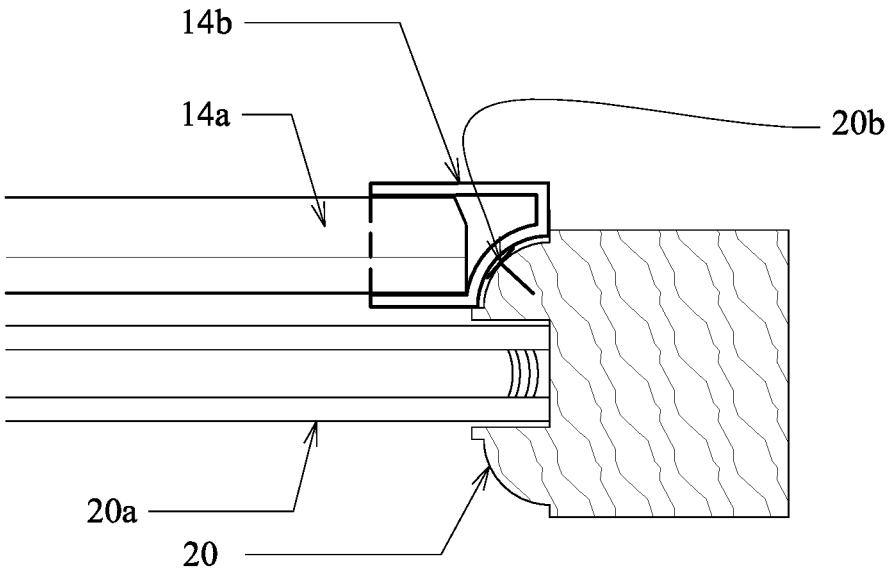
FIGS. 1A-1D show embodiments of magnetic window grid structures according to the disclosure having magnetic caps or clips for positioning on muntins.
Figure 1B:
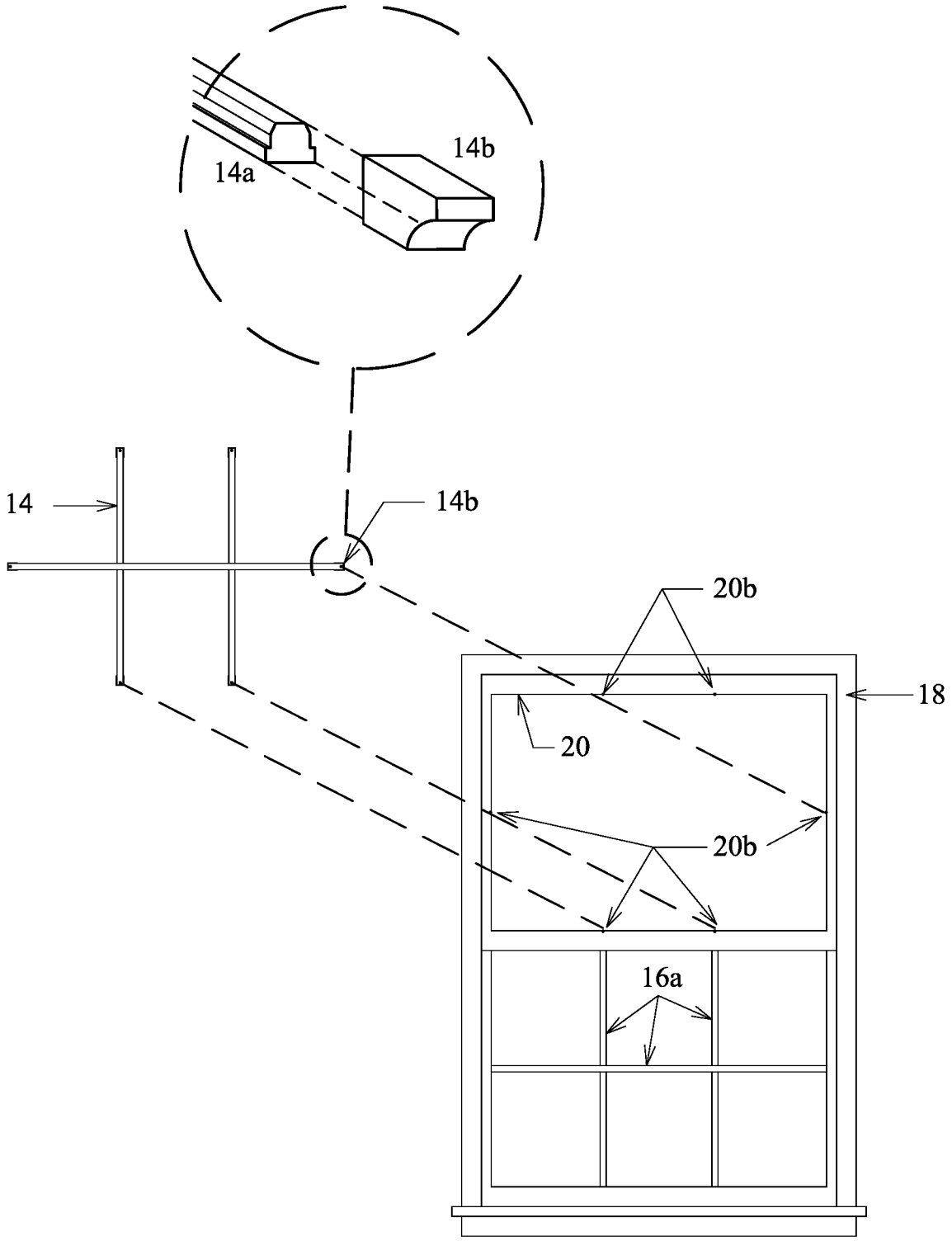

With initial reference to FIGS. 1A and 1B, there is shown a window system 10 having a window 12 that includes an upper removable member 14 and a lower removable member 16.

For the depicted embodiment, the removable members 14 and 16 are depicted as grids and referred to as grid 14 and grid 16. The embodiment of FIGS. 1A-1B is particularly configured for retrofit applications as described more fully below. Typically, the removable members 14 and 16 when configured as grids will be located on an interior side of the window 12.

The window 12 includes a frame 18, an upper sash 20, and a lower sash 22. The frame 18 has a head 18*a*, a sill 18*b*, and sides 18*c*. The upper sash 20 includes a pane 20*a* and the lower sash 22 includes a pane 22*a*. Magnetic elements 20*b* are located at desired perimeter locations of the upper sash 20.

The window 12 and the frame 18 are preferably made of wood, but may be made of other materials such as aluminum and vinyl. The pane 22*a* is preferably made of glass or plastic.

The magnetic elements 20*b* are applied to surfaces of the sash 20 or inserted into the sash 20 so as to be proximate the surface of the sash 20. The magnetic elements 20*b* may be magnets or ferromagnetic materials secured at desired locations around the sash 20. One exemplary embodiment of a magnetic element 20*b* may comprise a thumbtack that includes a pin secured to a head formed of a ferromagnetic material. The pin of this embodiment is suitable for being pushed into the sash 20 to secure the head at the surface of the sash 20.

In a similar manner as shown for the upper sash 20, the lower sash 22 includes magnetic elements located at desired perimeter locations of the lower sash 22.

The upper grid 14 is configured to overlie the upper sash 20 and rest against the pane 20*a* and includes muntins 14*a* arranged in a grid or other decorative pattern. The muntins 14*a* include a magnetic element 14*b* disposed at the ends thereof to align with and abut the magnetic elements 20*b* of the sash 20.

In the embodiment shown in FIGS. 1A and 1B, the magnetic elements 14*b* are shaped as caps made of a magnetic or ferromagnetic material and configured to slide over and frictionally engage the ends of the muntins 14*a*. Although the caps may be applied to new muntins, they are particularly desirable for use in retrofit applications. The caps may also be made of plastic and include a magnetic coating or have magnetic materials embedded therein.

For example, a conventional clip with a pin penetrating the sash may be removed from the muntin and replaced with the magnetic element 14*b* configured as the depicted cap. The cap embodiment also advantageously covers structures of the muntins used to receive the conventional clip with pin. In the case of the magnetic element 20*b* that comprises a ferromagnetic material, the magnetic element 14*b* is desirably comprises a magnetic material. Alternatively, both the magnetic elements 14*b* and 20*b* may comprise magnetic materials, but of opposite polarity so as to attract one another.

The lower grid 16 is configured to overlie the lower sash 22 and rest against the pane 22*a* and includes muntins 16*a* arranged in a grid or other decorative pattern. In a similar manner shown for the muntins 14*a*, the muntins 16*a* include a magnetic element disposed at the ends thereof to align with and abut the magnetic elements of the sash 22.

As will be noted, the magnetic elements 14*b* and the magnetic elements 20*b*, as well as the corresponding magnetic elements of the muntins 16*a* and the lower sash 22, are cooperating magnetic elements magnetically attracting and coupling to one another in a manner to firmly retain the grids 14 and 16 in position on the sashes 20 and 22, yet enable the grids 14 and 16 to be removed if desired.

Preferred materials for the magnetic elements 14*b* and 20*b* are permanent magnets, particularly rare-earth magnets, and ferromagnetic materials attracted by magnets, such as iron or nickel. A particularly preferred rare-earth magnet is a neodymium magnet, which is a type of rare-earth magnet made from an alloy of neodymium, iron and boron. For example, one magnetic element may be a magnet and the other a ferromagnetic material. Alternatively, both magnetic elements may be magnets but oriented to have unlike poles thereof adjacent one another to attract one another.

Figure 1C:
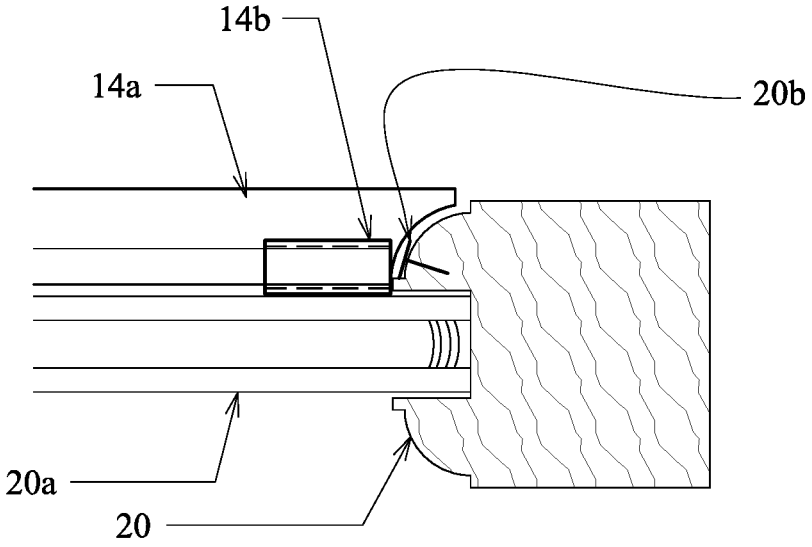
Figure 1D:
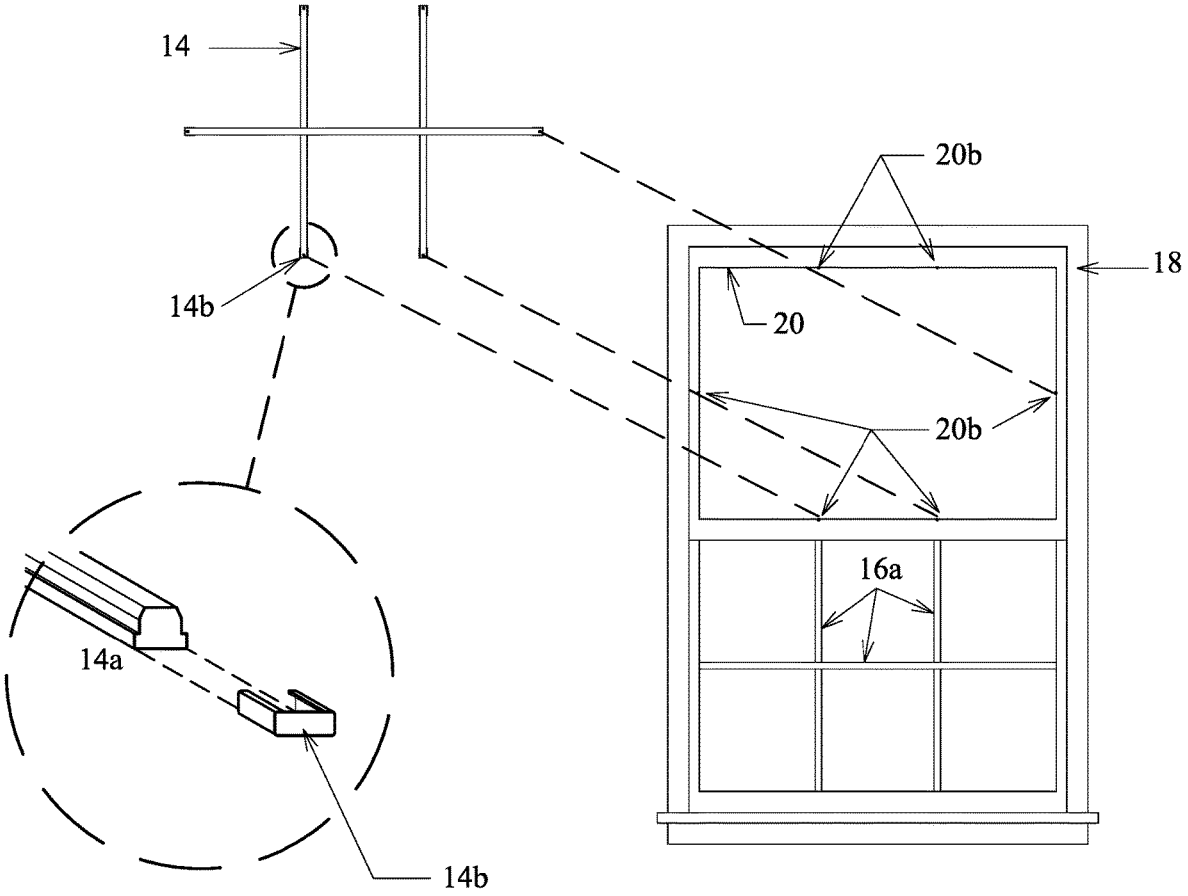

With reference now to FIGS. 1C-1D, there is shown another embodiment particularly configured for retrofit applications in which the magnetic elements 14*b* are configured as clips shaped in the manner of the conventional clips having pins. For retrofit applications the conventional clips with pins may be removed and replaced with the magnetic elements 14*b* preferably made of magnetic material or made of plastic and include a magnetic coating or have magnetic materials embedded therein. Locations on the sash that have been bored by the pins may have thumbtacks or like structures made of ferromagnetic material located in the bores of the sash to provide the magnetic elements 20*b* desirably located to magnetically couple with the magnetic elements 14*b*.

Figure 2A:
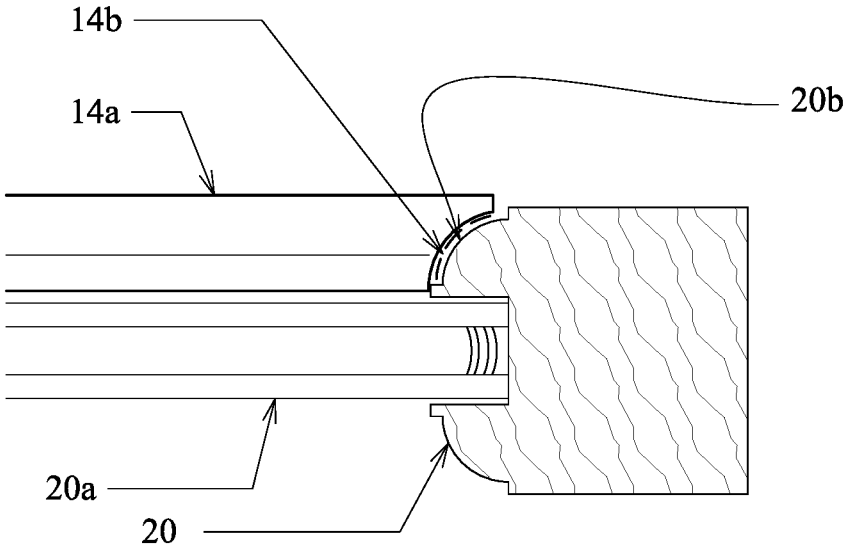
FIGS. 2A-2D show alternate embodiments of magnetic window grid structures according to the disclosure utilizing a coating, such as paint, having magnetic elements incorporated therein.
Figure 2B:
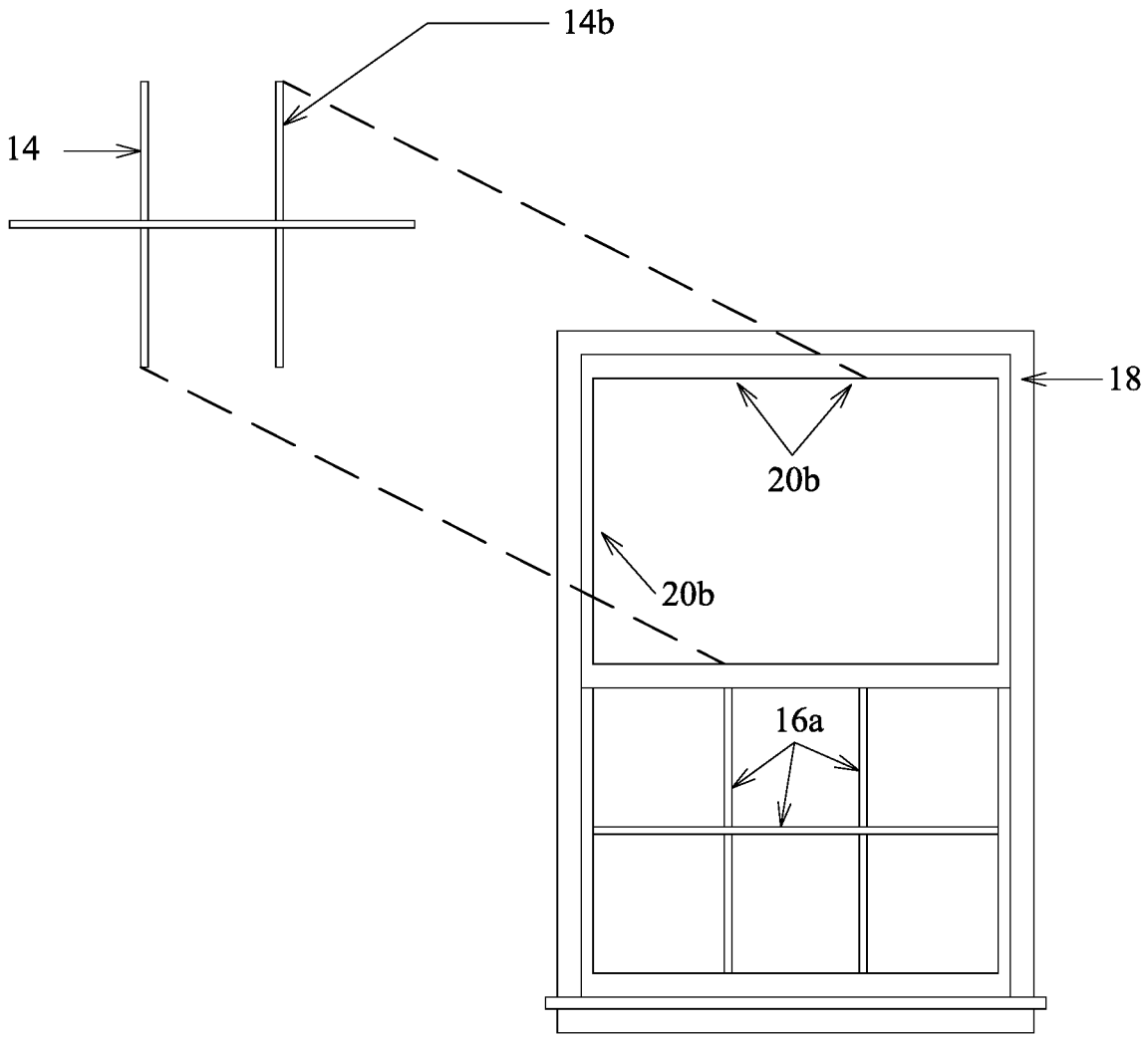

FIGS. 2A-2B show an alternative embodiment of a magnetic window grid structure according to the disclosure. As shown therein, the ends of the muntins 14*a* are painted with a magnetic paint or other coating layer containing powdered magnets or powdered ferromagnetic materials. For example, a neodymium or other magnet containing paint or ferromagnetic paint is applied to the ends of the muntins 14*a* to provide the magnetic elements 14*b*. Likewise, neodymium paint or ferromagnetic paint may be applied at the desired locations of the sash to provide the magnetic elements 20*b* of the sash 20 for magnetically coupling with the magnetic elements 14*b*. The foregoing described structures are also applicable for the muntins 16*a* and sash 22. This configuration is particularly useful for heavy and/or intricate window grids having little or no direct contact with the sash 20.

Figure 2C:
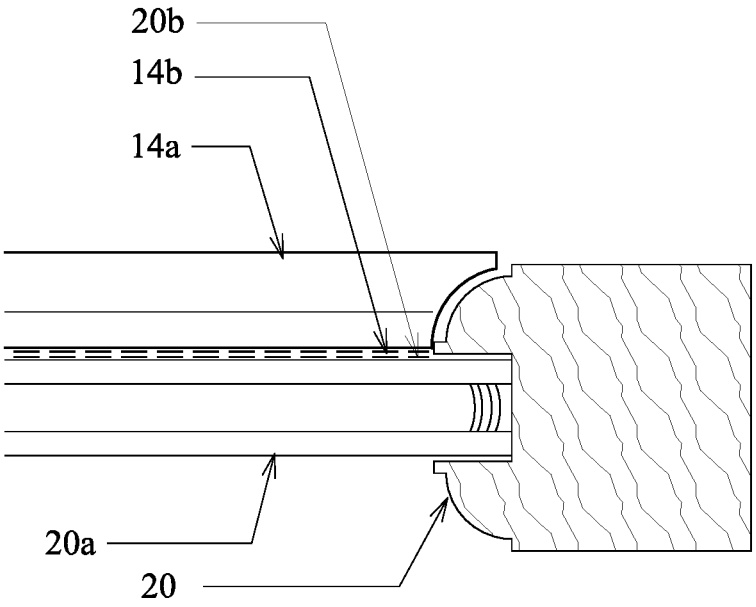
Figure 2D:
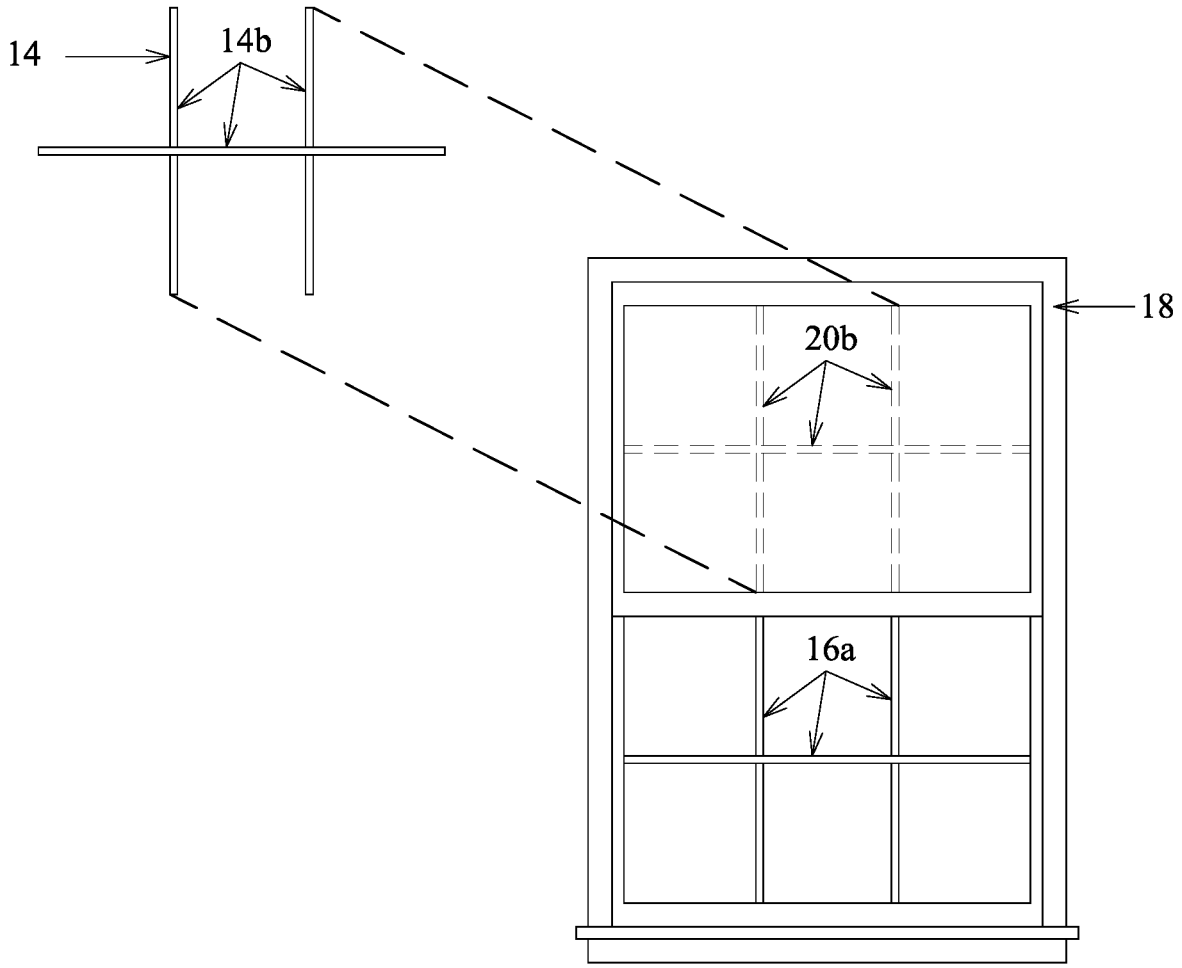

FIGS. 2C-2D show a further structure utilizing magnetic coatings such as magnetic paint and ferromagnetic paint. In this embodiment, the coating is applied in a corresponding grid pattern along the back surface of the muntins 14*a* to provide the magnetic elements 14*b*. To provide the magnetic elements 20*b*, a magnetically cooperating coating is applied to the facing surface of the pane 20 so as to underlie the muntin 14*a* when installed and magnetically couple to the magnetic elements 14*b*.

Figure 3A:
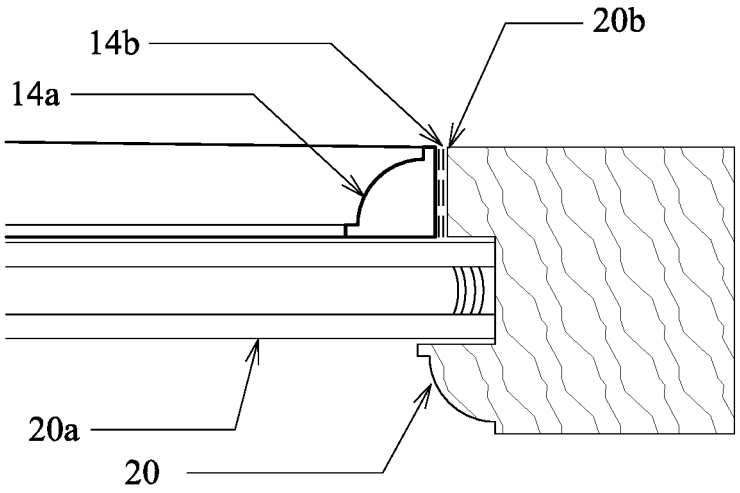
FIGS. 3A-3D show further alternate embodiments of magnetic window grid structures according to the disclosure in which the grid has a surrounding frame.
Figure 3B:
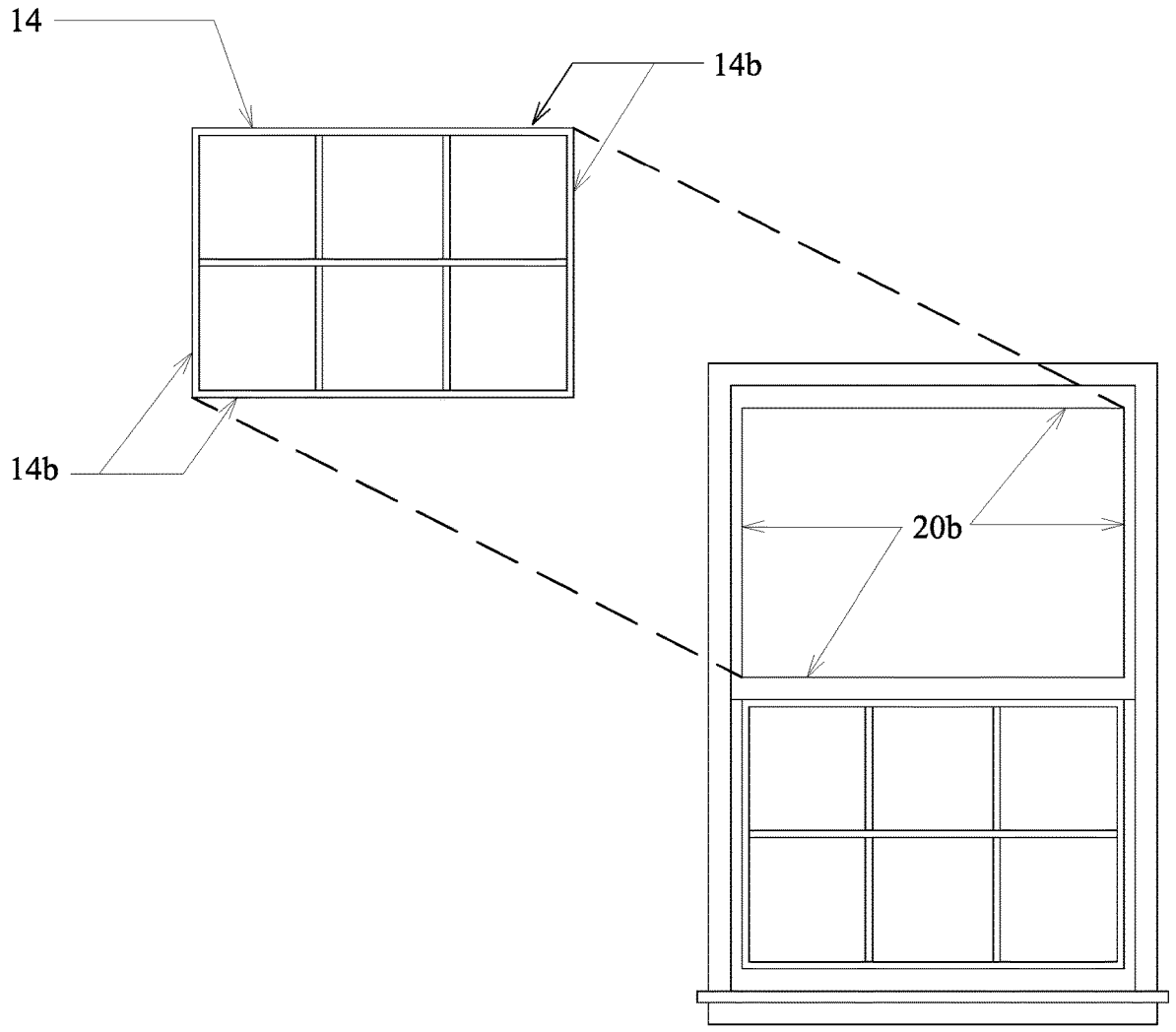

FIGS. 3A-3B show yet another structure desirably utilizing magnetic coatings to provide the cooperating magnetic elements 14*b* and 20*b*. As shown, the grid 14 includes a surrounding frame, with the magnetic paint or other coating applied to the outer perimeter of the frame. A cooperating magnetic coating is applied to the interior perimeter of the sash 20. The grid 14 is then installed easily by placing the grid 14 into the sash 20 with the magnetic elements 14*b* and 20*b* magnetically cooperating to maintain the grid 14 in place on the sash 20. This configuration is particularly desirable for new windows as the coatings may be easily and accurately applied during construction. Alternatively, instead of use of magnetic coatings, the elements 14*b* and 20*b* may be magnetic or ferromagnetic materials embedded or otherwise incorporated into the perimeters of the frame and the sash during manufacture.

Figure 3C:
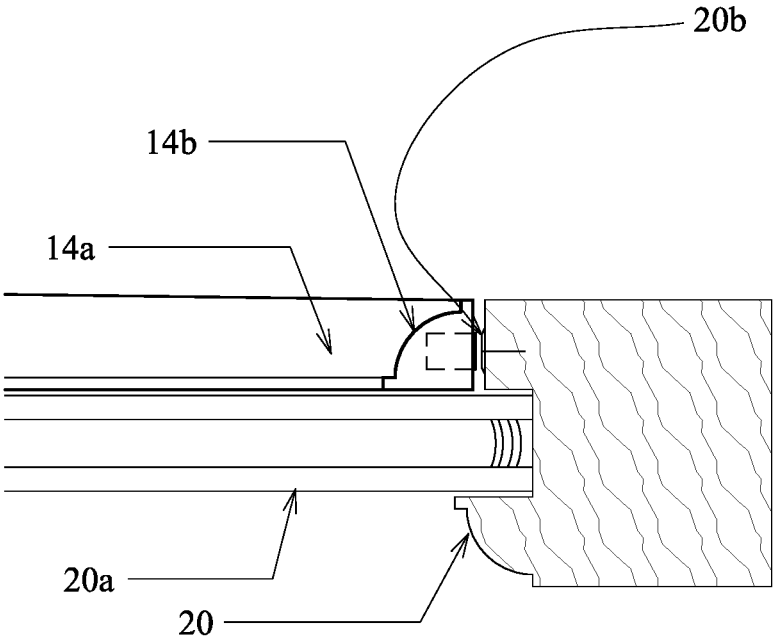
Figure 3D:
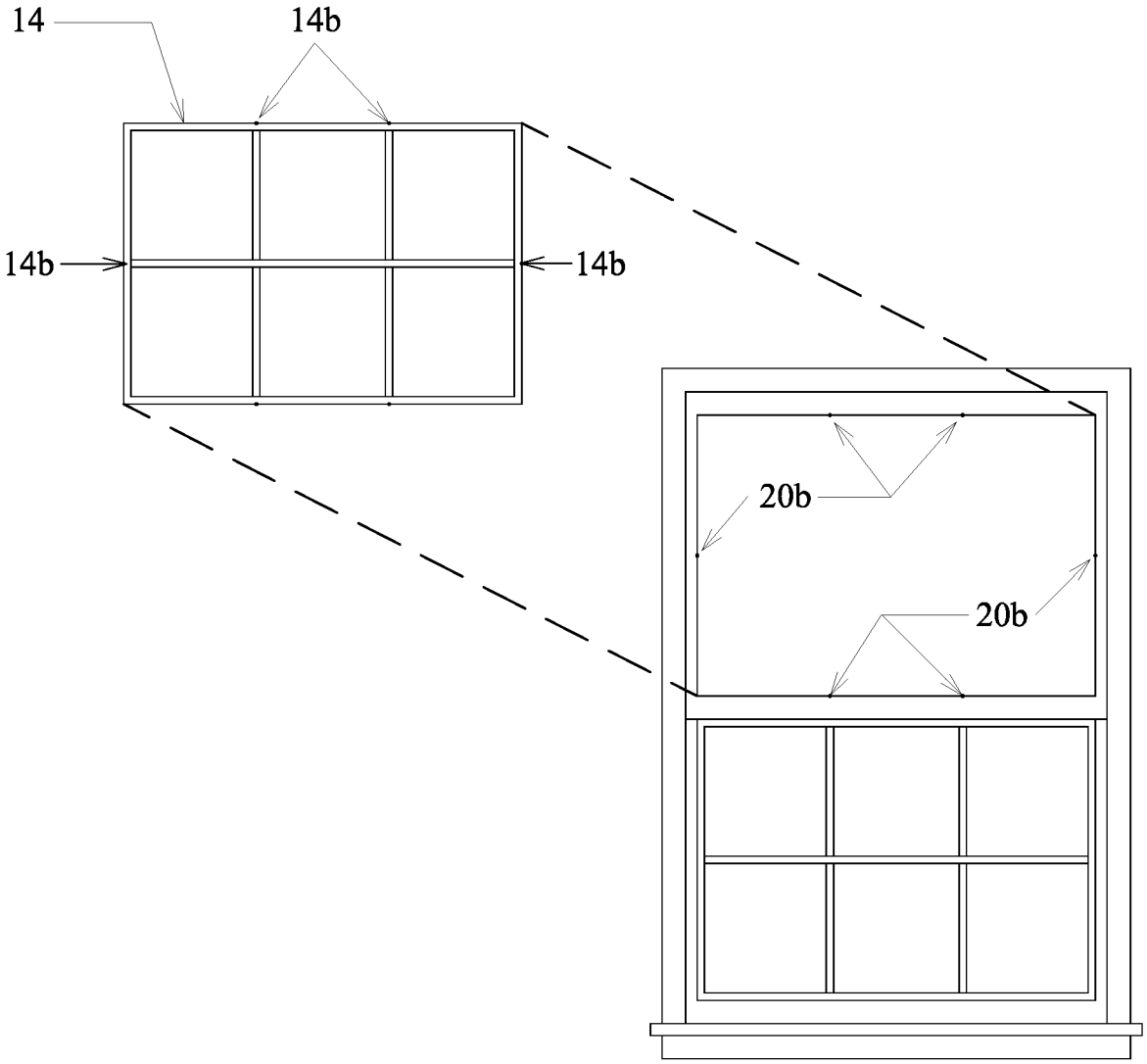

FIGS. 3C-3D show a structure similar to the structure of FIGS. 3A-3B in that the magnetic elements 14*b* are located on the outer perimeter of a grid 14 configured to have a frame, and the magnetic elements 20*b* are located on the interior perimeter of the sash 20. However, instead of the magnetic elements 14*b* and 20*b* being continuous around the perimeters, they are located at discrete locations of the perimeters.

Figure 4A:
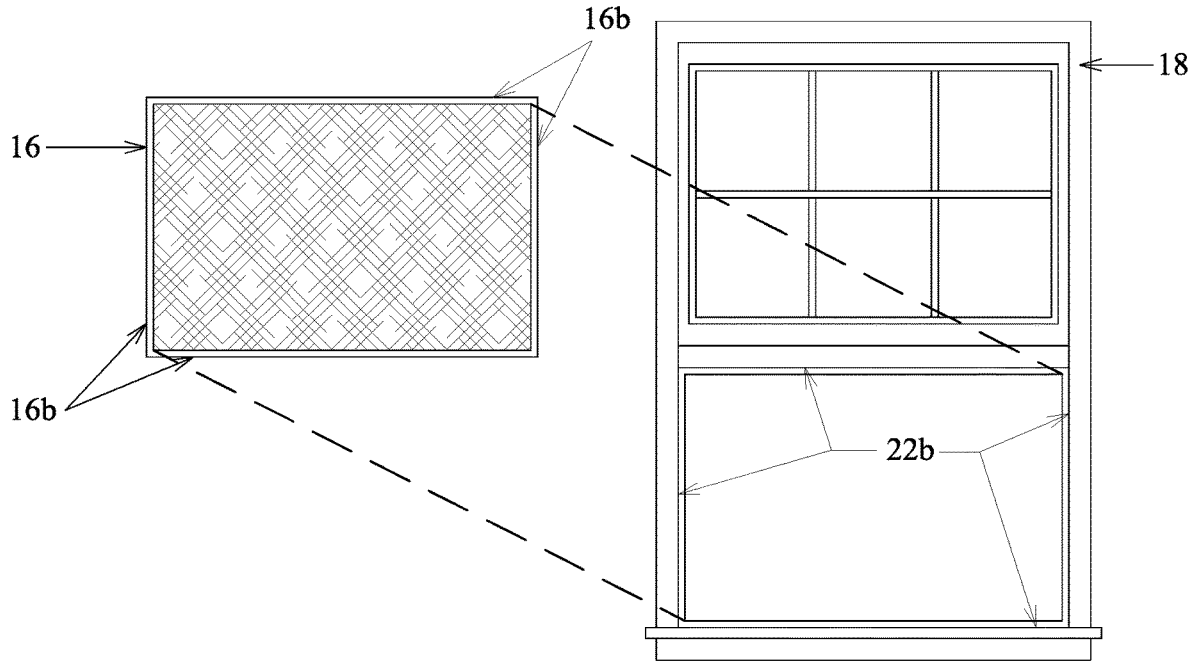
FIGS. 4A-4D show magnetic window screens and glazing according to the disclosure.
Figure 4B:
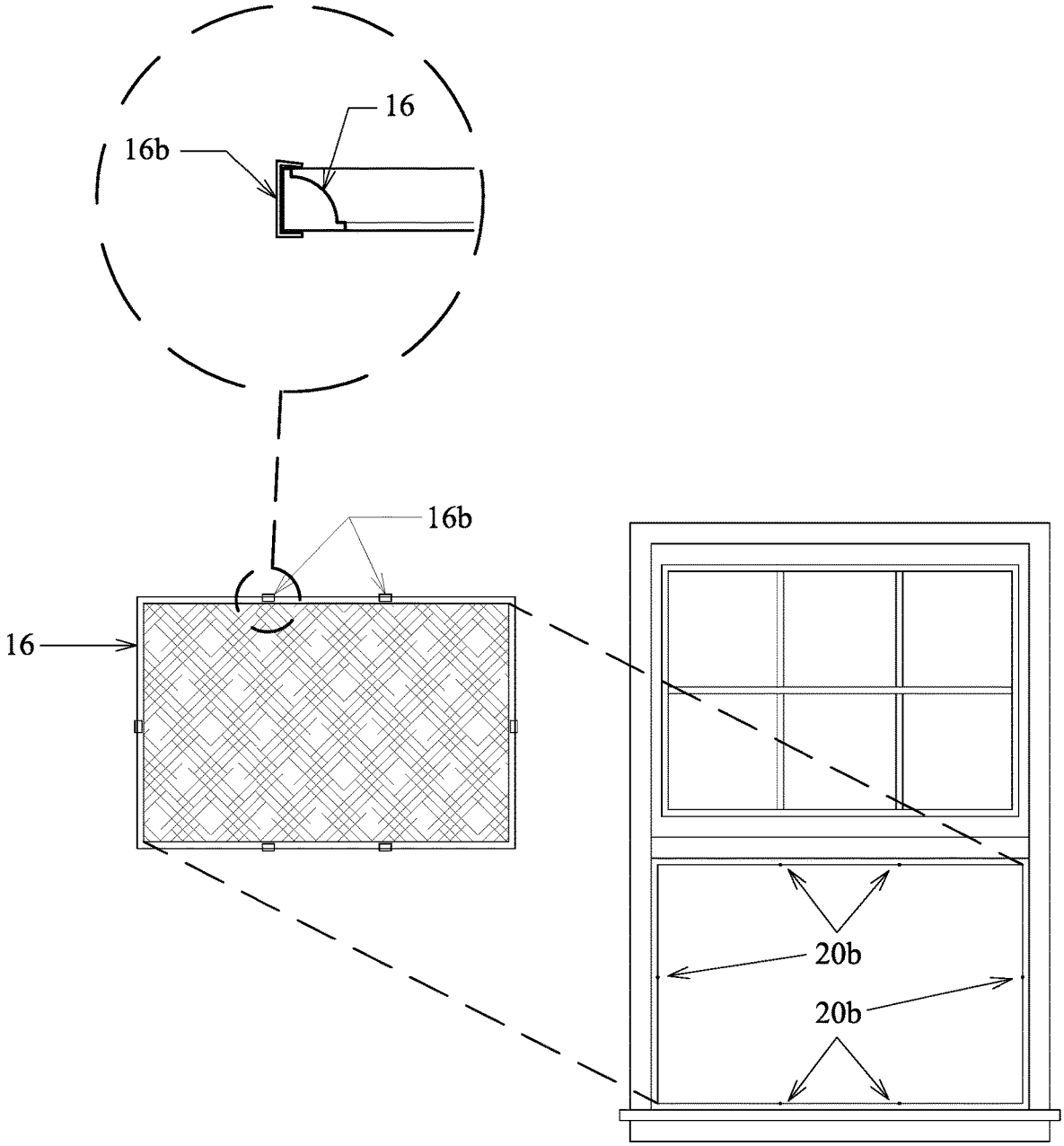

FIGS. 4A-4B show a structure similar to that of FIGS. 3A-3B, except the removable member 16 is configured as a window screen having magnetic elements 16*b* located about an outer perimeter of a frame of the window screen to magnetically couple with magnetic elements 22*b* of the sash 22. The magnetic elements 16*b* may comprise a magnetic coating at specific locations or continuously around the frame of the window screen, such as shown in FIG. 4A. As shown in FIG. 4B, the magnetic elements 16*b* may be clip structures that attach to the frame. The clip structures may be made of magnetic material or made of other material such as plastic having a magnetic material coated thereon or embedded therein. The depicted embodiments may also be utilized with a grid located on an interior side of the window and the window screen located on an exterior side of the window.

Figure 4C:
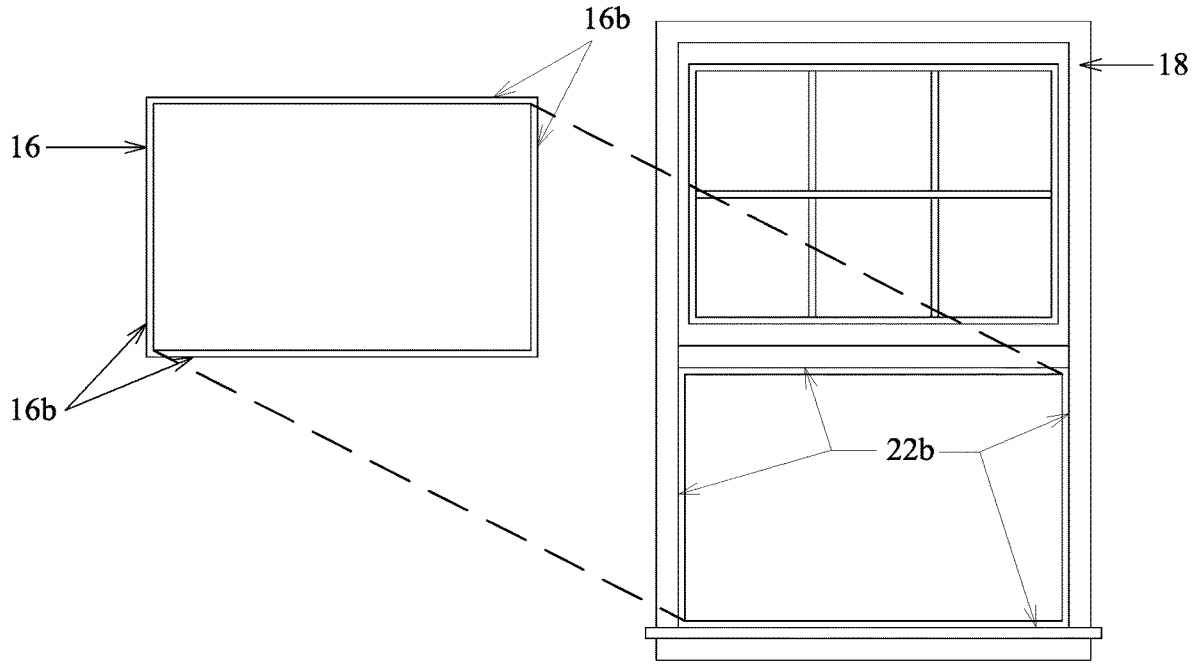
Figure 4D:
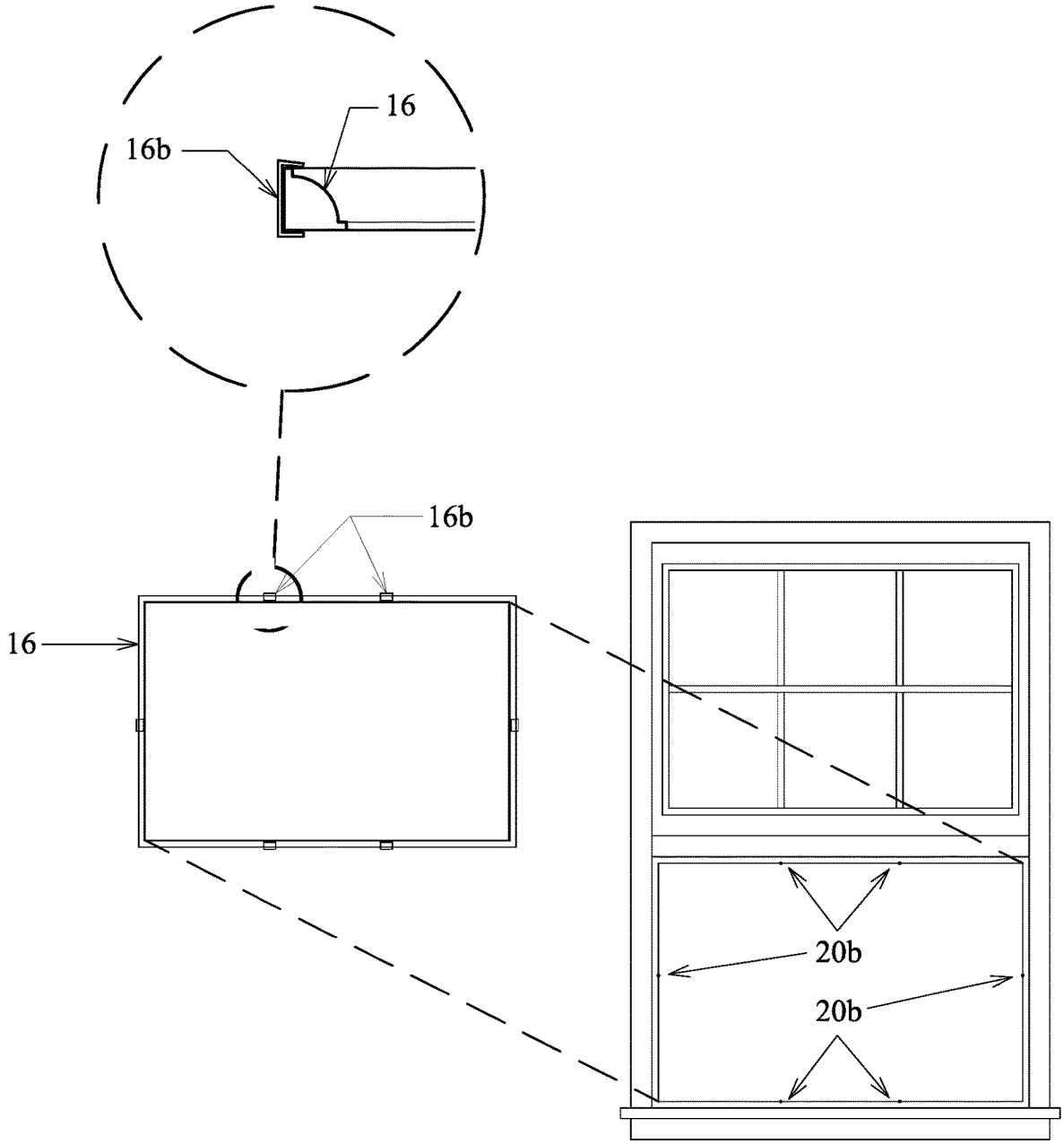

FIGS. 4C-4D show structures similar to that of FIGS. 4A-4B, except the removable member 16 is configured as a pane of glazing material fixed within a frame having magnetic elements 16*b* located about an outer perimeter of the frame to magnetically couple with magnetic elements 22*b* of the sash 22. The magnetic elements 16*b* may comprise a magnetic coating at specific locations or continuously around the frame, such as shown in FIG. 4C. As shown FIG. 4D, the magnetic elements 16*b* may be clip structures that attach to the frame. The clip structures may be made of magnetic material or other material such as plastic having a magnetic material coated thereon or embedded therein. The depicted embodiments may also be utilized with a grid located on an interior side of the window and the glazing material located on an exterior side of the window.

In certain embodiments, the glazing material may be a pane of clear, transparent glass, polycarbonate, fiberglass, or other similar material. Adding glazing materials to the window 12 may be desirable to increase energy efficiency by providing an insulating air gap between the sash 22 and the removable member 16. In another embodiment, the glazing material may be a pane of tinted glass, polycarbonate, fiberglass, or other similar material and may limit the amount of light penetrating the window 12. In a further embodiment, the glazing material may be a pane of opaque glass, polycarbonate, fiberglass, or other similar material impervious to light penetration.

Figure 5A:
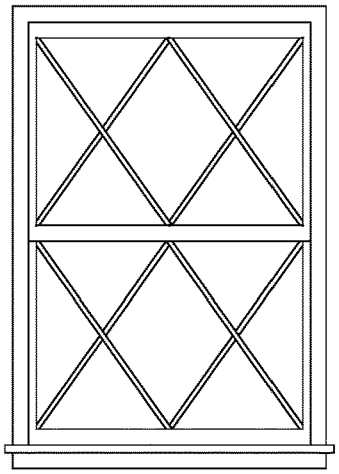
FIGS. 5A-5F show additional examples of window grid configurations for use with the magnetic structures according to the disclosure.
Figure 5B:
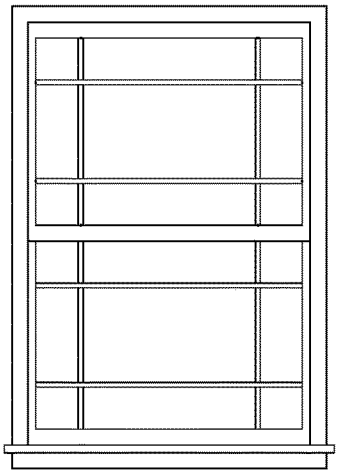
Figure 5C:
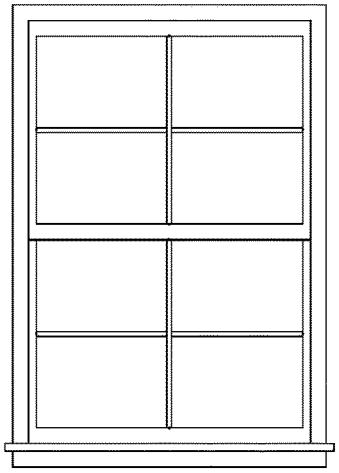
Figure 5D:
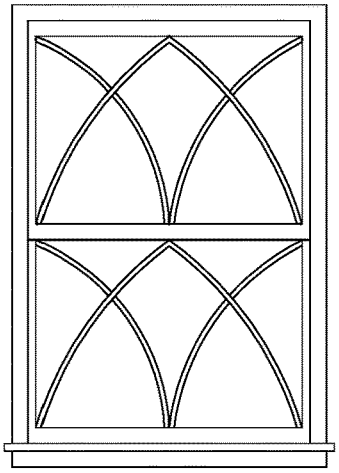
Figure 5E:
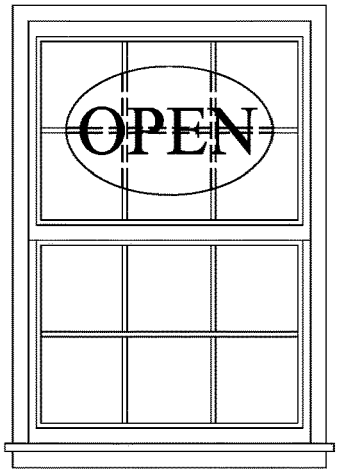
Figure 5F:
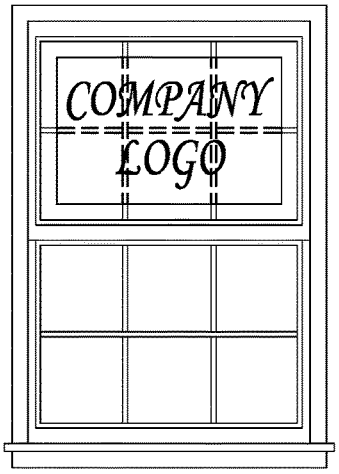

FIGS. 5A-5F show additional examples of window grid configurations for use with the magnetic attachment structures according to the disclosure. As will be appreciated, the described structures for mounting a removable member, such as a decorative grid relative to a pane on a sash, enable secure mounting of removable members of a wide variety of shapes that would otherwise be difficult to mount and susceptible to breakage from conventional mounting devices. The decorative grid may also include signage that contains text or imagery, as shown in FIGS. 5E and 5F. In some embodiments, lighting elements may be included in the decorative grid.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

The invention claimed is:

1. A retrofit window kit for retrofitting a window having a sash and a removable muntin grid having ends disposed adjacent an interior perimeter of the sash, the kit comprising:

a plurality of magnetic sash elements configured to be at least partially embedded into the sash at one or more locations on the interior perimeter of the sash;

a corresponding plurality of magnetic window grid elements, each comprising a clip or cap that fits over and frictionally attaches to one of the ends of the muntin grid, and each configured to magnetically couple to one of the magnetic sash elements; and signage attached to the muntin grid, wherein the signage comprises one or both of textual components and graphic components.

2. The kit of claim 1, wherein the sash elements comprise tacks having a ferromagnetic head.

3. The kit of claim 1, wherein the magnetic sash elements comprise magnets or ferromagnetic materials and the magnetic window grid elements comprise magnets or ferromagnetic materials.

4. The kit of claim 1, wherein each clip or cap comprises a magnetic material or has a magnetic material embedded therein.

5. A window system, comprising:

a window having a sash with a pane and an interior perimeter;

magnetic sash elements secured directly to the interior perimeter of the sash;

a removable muntin grid disposed on the sash so as to overlie the pane, the muntin grid comprising surfaces disposed adjacent the interior perimeter of the sash, and including signage comprising one or both of textual components and graphic components; and magnetic grid elements attached to the surfaces of the muntin grid and configured to magnetically couple to the magnetic sash elements when the muntin grid is disposed on the sash, wherein the magnetic sash elements or the magnetic grid elements comprise a magnetic coating.

6. The window system of claim 5, wherein the magnetic coating comprises magnetic paint.

7. The window system of claim 5, wherein one or both of the magnetic sash elements and the magnetic grid elements comprise a magnetic coating applied to the pane.

8. A window system, comprising:

a window having a sash with a pane surrounded by an interior perimeter of the sash;

magnetic sash elements secured directly to the interior perimeter of the sash;

a continuous removable frame having an exterior perimeter, the frame being disposed on the sash so as to overlie the pane with the exterior perimeter of the frame adjacent the interior perimeter of the sash; and magnetic frame elements located on the exterior perimeter the frame and configured to magnetically couple to the magnetic sash elements when the frame is positioned on the sash, wherein the frame secures a window screen, a pane of glass, a pane of plexiglass, or similar glazing material.

9. The window system of claim 8, wherein one or both of the magnetic sash elements and the magnetic frame elements comprises a magnetic coating.

10. The window system of claim 9, wherein the magnetic coating comprises powdered magnets or powdered ferromagnetic materials in a coating layer.

11. The window system of claim 8, wherein the magnetic sash elements are at least partially embedded in the sash.

12. The window system of claim 8, wherein the magnetic frame elements are at least partially embedded in the frame.

13. The window system of claim 8, wherein the magnetic frame elements comprise clips attached to the frame.

14. The window system of claim 13, wherein the clips are coated with a magnetic material or have a magnetic material embedded therein.

15. The window system of claim 8, wherein the frame comprises a window grid.

16. The window system of claim 8, wherein the frame includes signage comprising one or both of textual components and graphic components.

* * * * *